United States Patent [19]

Sherwood

[11] 4,095,696

[45] Jun. 20, 1978

[54] PRODUCE GRADER

[75] Inventor: John R. Sherwood, Arlington, Va.

[73] Assignee: AMF Incorporated, White Plains, N.Y.

[21] Appl. No.: 765,716

[22] Filed: Feb. 4, 1977

[51] Int. Cl.[2] ..... B07C 5/342

[52] U.S. Cl. ..... 209/75; 209/111.6; 250/226; 250/223 R

[58] Field of Search ..... 209/111.6, 111.7, 111.5, 209/75; 250/223 R, 226

[56] References Cited

U.S. PATENT DOCUMENTS

| | | | |
|---|---|---|---|
| 3,781,554 | 12/1973 | Krivoshiev | 209/111.6 X |
| 3,980,181 | 9/1976 | Hoover | 209/111.6 |
| 3,981,590 | 9/1976 | Perkins | 250/227 |
| 3,998,555 | 12/1976 | Babb | 209/111.6 X |
| 4,057,352 | 11/1977 | Babb | 209/111.6 X |

*Primary Examiner*—Allen N. Knowles
*Attorney, Agent, or Firm*—George W. Price; John H. Gallagher

[57] ABSTRACT

In accordance with the present invention, light from tungsten lamps is directed onto tomatoes moving in parallel rows on a conveyor belt. Above each row of tomatoes three photodetectors having different spectral responses are employed for looking at three different wavelengths of light reflected from the tomatoes. One of the wavelengths is the visible red color, the second one is the so-called "water dip" wavelength in the near infra red, and the third one is a reference wavelength in the near infra red. By means of logic circuitry operating in response to the three photodetector output signals, red tomatoes are separated from all other articles on the conveyor, including dirt and rocks. The logic circuitry "asks" the following questions. Is an article present? Is the article vegetable matter? Is the article red? If all questions are answered in the affirmative the article is processed as a desired red tomato. If any one of the questions is answered in the negative the article is rejected as undesirable. Thus, non-vegetable dirt and rocks will be rejected even though they may have enough red color in them to make a logic circuit "think" that they are a red tomato.

5 Claims, 6 Drawing Figures

PRODUCE GRADER

BACKGROUND OF THE INVENTION

A produce grader or sorter that is useful for sorting tomatoes according to their colors is disclosed in U.S. Pat. No. 3,944,819 issued Mar. 16, 1976 to J. R. Sherwood. Tomato sorters constructed according to the teachings of that patent have been used successfully to separate undesired green tomatoes from desired red tomatoes. When such a tomato sorter is mounted on a tomato harvester that harvests tomatoes from the growing vines in the fields, a considerable quantity of dirt clods and rocks will pass to the sorter along with the harvested tomatoes. It is desirable that the sorter be able to distinguish dirt and rocks from the produce and reject them along with the undesired articles of produce. Although the above-mentioned system satisfactorily separated desirable and undesirable tomatoes, it was not as effective as desired in rejecting dirt clods and rocks.

BREIF DESCRIPTION OF THE DRAWINGS

DETAILED DESCRIPTION OF PREFERRED EMBODIMENT

The invention will be described in connection with sorting tomatoes according to their colors. It is to be understood that other articles of fruits or vegetables, and tobacco leaves, for example, could be sorted in accordance with their colors by selecting proper light sources, filters and optical detectors, as required.

Figure 1:
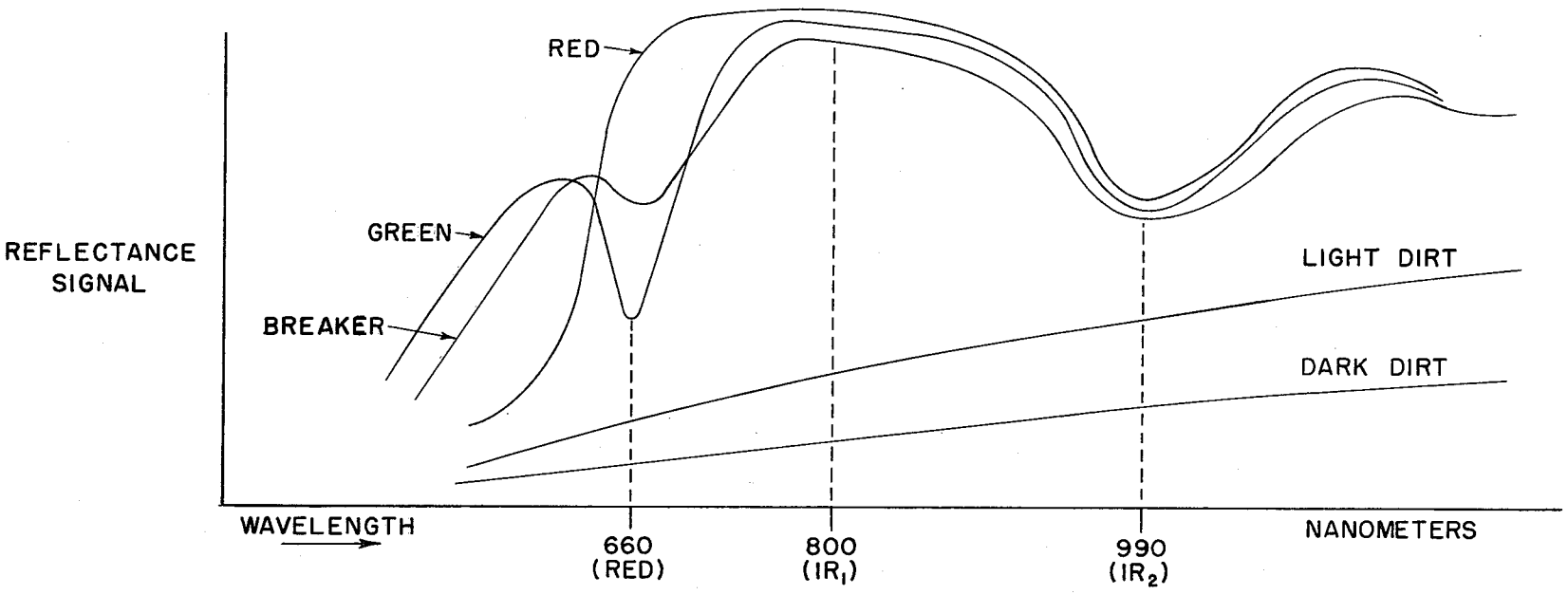
FIG. 1 is a series of curves illustrating the spectral reflectance of several types of tomatoes that are to be sorted.

It is believed that the significance of the present invention will be better understood if the light reflectance of tomatoes and dirt are first investigated. FIG. 1 is a graphical representation of the light reflectance of red, green and "breaker" tomatoes, and of light and dark colored dirt as a function of light wavelengths that includes the visible spectrum as well as the near infra red. Looking first at 660 nanometers (nm), it is seen that a red tomato has a strong reflectance and that a breaker tomato has a moderate reflectance, but a green tomato experiences a dip and has a significantly lower reflectance. It also is seen that all three types of tomatoes have rather large values of reflectance in the near infra red region of 800 nm. All three types of tomatoes suffer a dip in their reflectance curves in the near infra red region of 990 nm. This dip is the so called "water dip" that is characteristic of many fruits and vegetables. This term "water dip" actually is a misnomer since water alone and wet dirt, for example, do not exhibit a dip at 990 nm.

The above-mentioned "breaker" tomatoes are greenish-white on their outsides but are mature and red on the inside. Breaker tomatoes often can be considered desirable and may be accepted along with red tomatoes. Consequently, a good tomato sorter will have a high degree of breaker color resolution with a selectable threshold.

Looking now at the two curves for dark and light dirt, it is seen that each increases with a respective substantially constant slope as a function of increasing wavelength, i.e., each is a monotonic function of light wavelength. Neither curve experiences a dip in the region of 990 nm.

It can be seen that if the reflectance of tomatoes at 660 nm is monitored it is possible to distinguish between red and green tomatoes. Similarly, by monitoring the reflectance of articles at 990 nm it is possible to tell the difference between vegetable matter (tomatoes) and nonvegetable matter (dirt and dirt covered rocks). In the sorter system of this invention, the monitored wavelength signals at 660 nm and 990 nm are compared against a monitored reference wavelength signal, at 800 nm for example, to compensate for the effects caused by variations in the sizes of tomatoes, ambient light variations, and voltage variations in the electronic system. The monitored reference signal also may be used to indicate the presence of an article at the inspection position.

Figure 2:
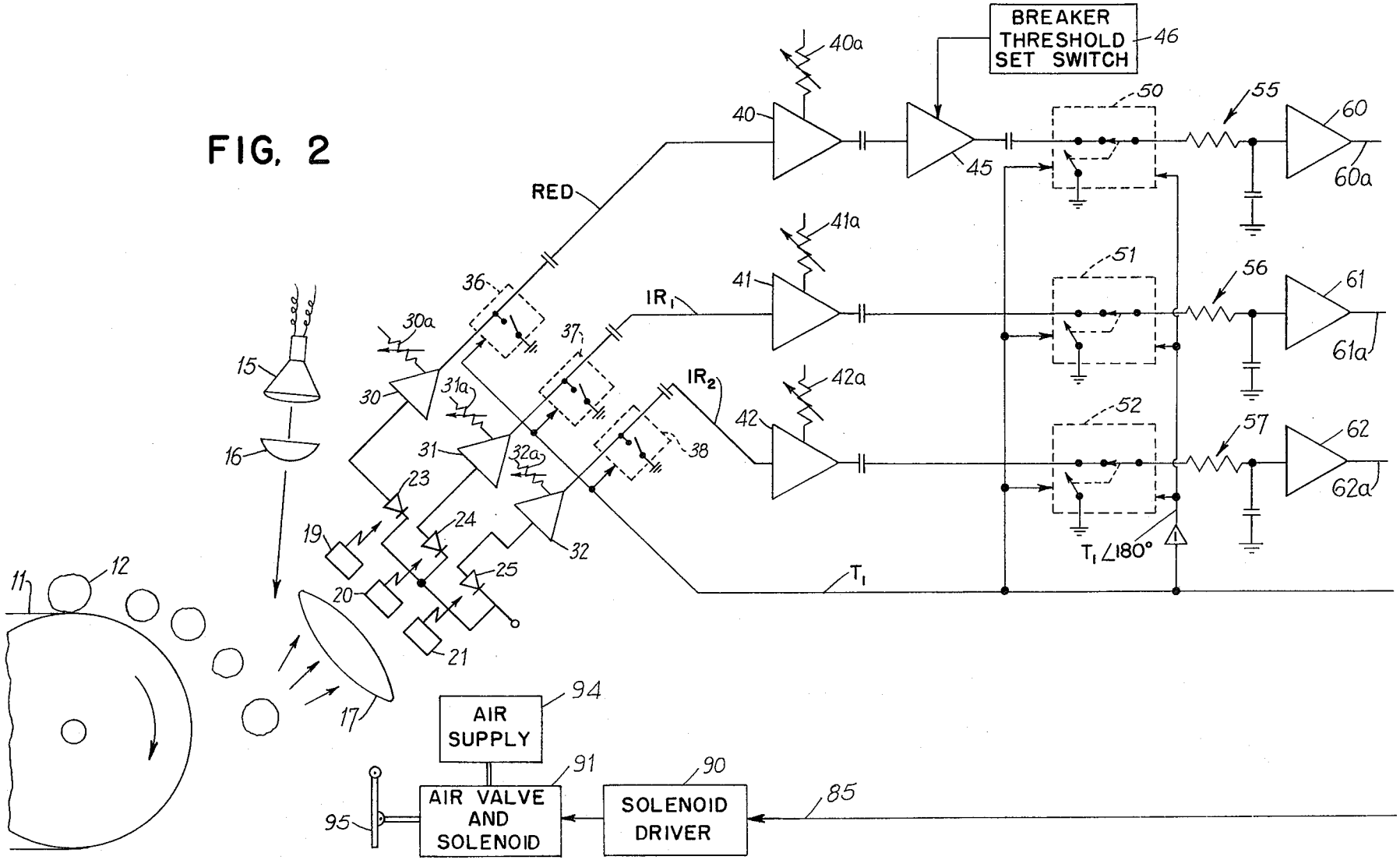
FIG. 2 is a simplified diagram, mostly in block form, illustrating the front portion of a tomato sorter constructed in accordance with this invention.

Referring now to the sorting system of this invention, FIG. 2 is a simplified illustration of the electro optical portion of the system that is located at an inspection position on a harvester, for example. A continuous conveyor belt 11 carries the articles of produce such as tomatoes 12 in a single file to the end of the conveyor where the articles are discharged in a free fall path. A light source 15, such as a tungsten lamp, and a hemispherical bar lens 16, produce a narrow beam of collimated light that illuminates the discharged tomatoes. Light reflected from a tomato passes through a lens system 17 that uniformly distributes the reflected light onto three filters 19, 20, and 21. The three filters have pass bands approximately 20 nm wide respectively centered at approximately 660 nm, 800 nm, and 990 nm. Positioned immediately behind the filters and illuminated by the light passing through them are photodetectors 23, 24, and 25. In practice, detectors 23, 24, and 25 may be photodiodes operated in the short circuit mode. Type 21D81 photodiodes, sold by Vac Tec Inc., Maryland Heights, Mo. are satisfactory.

The outputs of the photodetectors are coupled to respective d.c. amplifiers 30, 31 and 32. The amplifiers have respective variable resistors 30*a*, 31*a*, and 32*a* which are used to null the output signals of the amplifier during the adjustment and calibration of the apparatus.

The optical system and electro optic detecting apparatus described thus far may be the type described in detail in U.S. Pat. No. 3,981,590 issued Sept. 21, 1976 to J. R. Perkins.

On a commercial tomato sorter, belt 11 may have as many as eight or more successions of tomatoes moving in parallel along the conveyor. For simplicity, the present discussion is limited to a single succession of tomatoes moving along conveyor belt 11 and to a single color sorter electronic signal channel. (A channel includes three signal lines, one for each monitored color.) In practice, each aligned succession of tomatoes will have associated with it an electro optic inspection head, a color sorter electronic channel, and an article ejection means.

In FIG. 2, the outputs of d.c. amplifiers 30, 31, and 32 are coupled to respective electronic choppers 36, 37, and 38 where the signals are converted to alternating current signals that are more suitable for amplification.

Choppers 36, 37 and 38 are in fact FET electronic switches that operate in response to a square wave gating signal T1 at a frequency of 714 Hz, for example, to repeatedly ground the outputs of the d.c. amplifiers and thus produce the a.c. signals.

The three a.c. signals whose amplitudes correspond to the reflected light at 660 nm (red), 800 nm ($IR_1$), and 990 nm ($IR_2$) and capacitively coupled to respective a.c. amplifiers 40, 41, and 42. Each amplifier has a respective calibration adjustment means 40*a*, 41*a*, 42*a*, associated with it to permit the signal lines to be calibrated prior to field operation. This calibration is performed while a standard color plate is held in front of the optic head.

Another a.c. amplifier 45 is in the red signal line. No corresponding amplifiers are in the $IR_1$ or $IR_2$ signal lines. The gain of amplifier 45 is adjustable in discrete, uniform steps by means of breaker threshold set switch 46. It is by means of this set switch 46 that the operator of the sorter can determine the "cut point" of the color sorting. That is, set switch 46 sets the gain in the red signal line to cause all tomatoes more red than a fixed color to be accepted and all tomatoes more green than that fixed color to be rejected. Set switch 46 is comprised of parallel connected, binary weighted resistors (representing binary digits) connected in the feedback circuit of an operational amplifier. One end of each binary weighted resistor (binary digit) is connected to ground through an electronic switch which is opened and closed in response to a signal from a respective one of a plurality of binary coded thumbwheel switches. Selective operation of the binary coded thumbwheel switches closes corresponding switches associated with the binary weighted resistors to connect selected resistors to ground, thus changing the gain of the amplifier by a desired amount. In a sorter of this type, one binary switch controls the gains in all signal channels in an identical manner, thus preserving calibration of the apparatus. The above-mentioned Sherwood U.S. Pat. No. 3,944,819 also shows gain control means comprised of binary coded thumbwheel switches that control the gains in all signal channels by the same amount.

The three a.c. signals from a.c. amplifiers 45, 41, and 42 are converted back to d.c. signals by means of respective electronic synchronous demodulators or detectors 50, 51, and 52 and integrating circuits 55, 56, and 57. Each of the synchronous detectors is comprised of alternately operating shunt and series switches that operate in response to gating signals T1 and T1/180°. The switches are in fact electronic semiconductor switches.

Integrators 55, 56, and 57 are coupled to low pass filter and buffer amplifiers 60, 61, and 62 whose d.c. output signals on lines 60*a*, 61*a*, 62*a* correspond to the amount of red light at 660 nm, infra red light at 800 nm, and a second infra red light at 990 nm, respectively, that is reflected from an article being inspected.

The manner in which these signals are operated on to sort green tomatoes, dirt clods, and rocks from acceptable red tomatoes will be discussed in connection with the simplified circuit logic diagram of FIG. 3 and the accompanying waveforms of FIGS. 4–6. In this discussion it first will be assumed that an acceptable red tomato is at the inspection position being illuminated by light source 15.

The Red signal, FIG. 4*a*, on line 60*a* is coupled to one input terminal of a comparator circuit 67, and the $IR_1$ signal FIG. 4*b*, on line 61*a* is coupled as a reference signal to the other input terminal of comparator 67. Since it is assumed that an acceptable tomato is present, the Red signal will be sufficiently great to cause comparator 67 to produce the output signal of FIG. 4*d*.

The $IR_1$ reference signal, FIG. 4*b*, also is coupled to one input terminal of a second comparator circuit 68 and the $IR_2$ signal, FIG. 4*c*, on line 62*a* is coupled to the second input terminal of comparator 68. Since the article being viewed is vegetable matter, the $IR_2$ signal will experience the so called "water dip" and will be of reduced magnitude, thereby causing comparator 68 to produce the output signal of FIG. 4*e*.

The $IR_2$ signal, FIG. 4*c*, on input line 62*a* also is coupled to one input terminal of a third comparator circuit 69 and is compared against a reference voltage Ref. V. This reference voltage is a relatively low magnitude so that most articles over a given size that are present at the inspection position will produce enough reflection at 990 nm (see FIG. 1) to cause comparator 69 to produce the output signal of FIG. 2*f*.

It is seen that the waveform of FIG. 2*f* has a positive going leading edge that occurs slightly earlier than the corresponding leading edges on the waveforms of FIGS. 4*d* and 4*e*. Ideally, these three leading edges should be in time coincidence but because of the unavoidable different time constants in the respective red, $IR_1$, and $IR_2$ signal lines, the rise times on the waveforms of FIGS. 4*a*, 4*b*, and 4*c* will not be identical. As will be explained below, these small differences create no difficulties in the present system.

In terms of logic, the positive signals of FIGS. 4*f*, 4*e*, and 4*d* at the outputs of comparators 69, 68, and 67, respectively, represent the following statements.

An article is present at the inspection position.

The article is vegetable matter.

The article is red.

The logic signals are further processed as follows. Red signal FIG. 4*d* and $IR_1$ signal FIG. 4*e* both are present at the inputs of AND gate 72, so that a corresponding signal passes through that gate, is inverted by inverter 74 and appears at one input terminal of AND gate 77 as the negative going signal of FIG. 4*g*. The other input signal to AND gate 77 is the positive going $IR_2$ signal of FIG. 4*f*. Because of the above-mentioned slight difference in the times of occurrence of the leading edge transitions in the waveforms of FIG. 4*f* and 4*g*, they both are the same polarity only for a brief time at the beginning and end of the positive pulse of FIG. 4*f*. Consequently, AND gate 77 produces the short positive pulses of FIG. 2*h*. In this example these short pulses have a duration of approximately 2 milliseconds, and are coupled to the data input of a 64 bit shift register 83. (It must be kept in mind that these short pulses are not logic data, but are anomalies due to unequal circuit characteristics in the three signal lines.) The shift pulses for shift register 83 are obtained from clock source 86. As illustrated in FIG. 4*j*, the shift pulses occur at a 2.67 kHz rate and have a duration of approximately 375 microseconds. The pulses of FIG. 4*h* are shifted through register 83 and appear on output terminal 85 after a given delay therein. This delay is chosen to equal the time it takes a tomato to fall from the inspection position, see FIG. 2, to a position in front of ejection paddle 95 where it may be deflected from its free fall path, if required.

The output of shift register 83 on lead 85 is coupled to solenoid driver circuit 90, FIG. 2, whose output controls a solenoid operated air valve 91. When the solenoid is operated in response to a command signal from driver circuit 90, the air valve is operated to extend paddle 95 into the free fall path of an article and deflect it therefrom.

In the above example it was assumed that a red acceptable tomato was at the inspection position. Accordingly, paddle 95 should not be actuated yet, as seen in FIG. 4*k* a short duration (2 msecs) anomaly signal was passed through shift register 83. Paddle 95 is not in fact actuated because the inductance of the solenoid acts as an integrator or smoother to short duration signals and the solenoid will not be actuated by any pulsed signal that is shorter in duration than approximately 12 to 15 msecs. Consequently, the solenoid does not "see" the short duration pulses of FIG. 4*k*. It is to be understood that the anomaly signals could be eliminated by other means such as a pulse width discriminator, or the responses of the signal lines could be more closely matched so that substantially complete cancellation of the waveforms of FIGS. 4*f* and 4*g* will occur. The slower response time of the solenoid eliminates the need for these additional steps.

Figure 3:
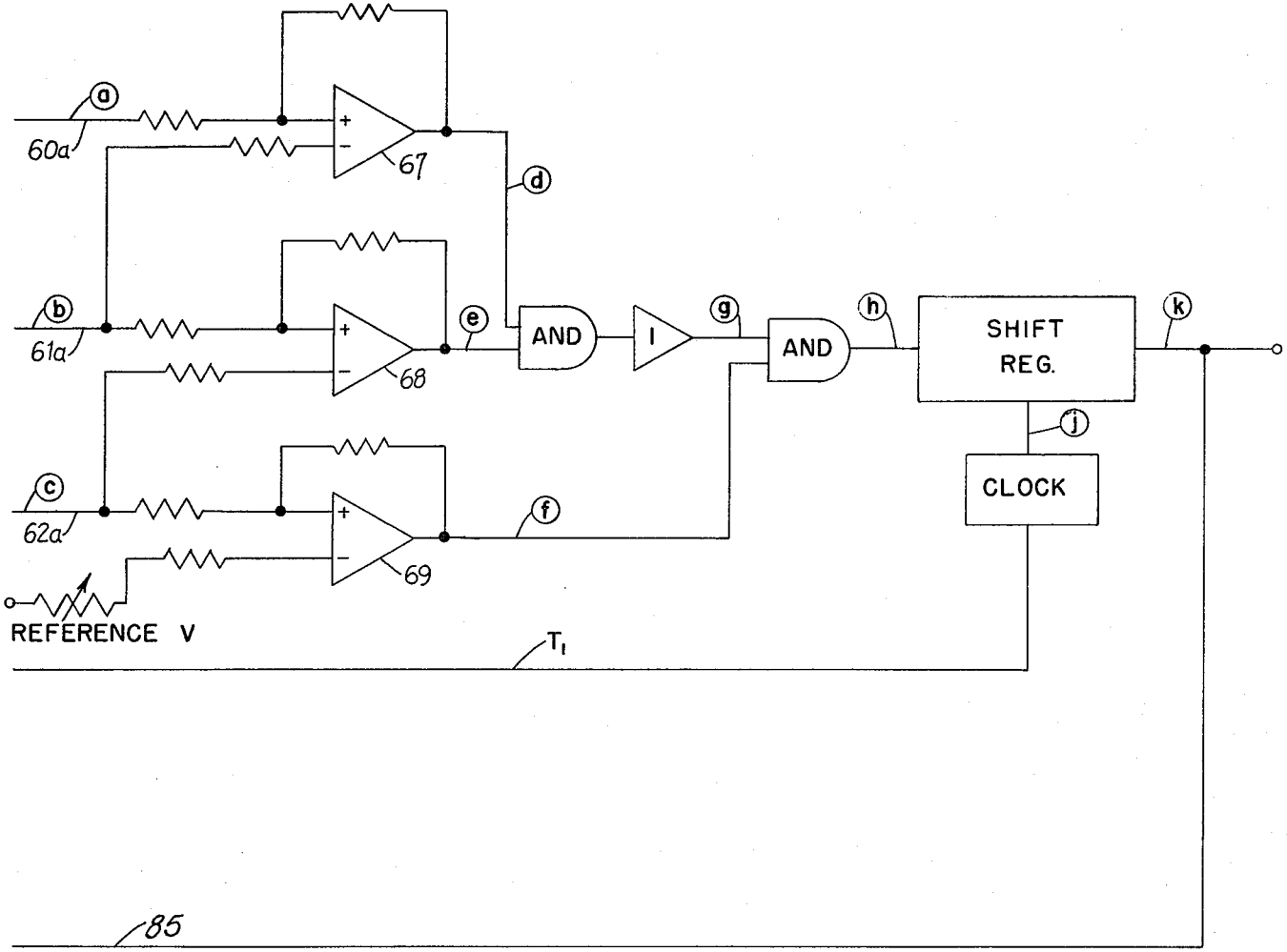
FIG. 3 is a simplified diagram of the remainder of the tomato sorter of this invention.
Figures 4, 5, 6:
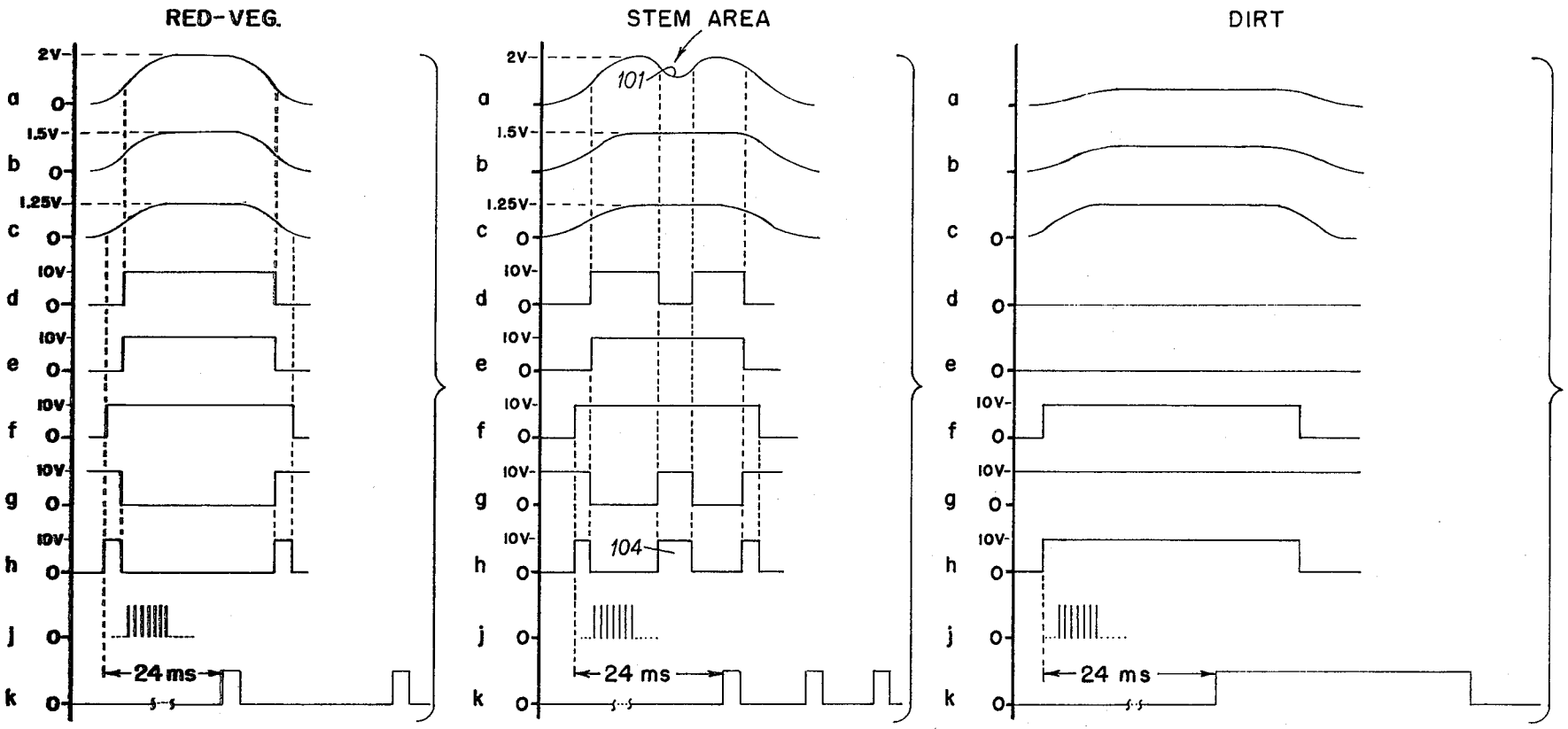
FIG. 4–6 are series of waveforms that occur at various places in the circuit of FIG. 3 and are used in describing the operation of the sorter of this invention.

FIG. 5 illustrates the waveforms that will occur when an acceptable red tomato is being viewed at the inspection position, but a green stem is on the tomato and is viewed by the optic system. The waveforms FIG. 5*a*–5*k* are similar to correspondingly designated waveforms of FIG. 4 and occur at the correspondingly designated places on FIG. 3. It is seen in FIG. 5*a* that a dip 101 occurs in the red signal when the stem area of the tomato is being viewed. This dip causes the output of comparator 67 to go low, FIG. 5*d*, approximately midway during the red signal. This signal ultimately causes the output waveform FIG. 5*h* from AND gate 77. The positive going pulse 104 is wider than an anomaly signal of FIG. 4*h*, but still is much too short in duration to energize the solenoid actuated valve 91. In effect, the system does not "see" the green stem.

The waveforms of FIG. 6 illustrate the signals that occur when a clod of dirt is being viewed at the inspection position. Referring briefly back to FIG. 1, it is seen that the reflectance of dirt at 660 nm (Red) is lower than its reflectance at 800 nm ($IR_1$), and that its reflectance at 990 nm ($IR_2$) is the highest of the three. The waveforms of FIGS. 6*a*, 6*b*, and 6*c* illustrate the three color signal that would be present on signal lines 60*a*, 61*a*, 62*a* of FIG. 3 when a dirt clod is being viewed at the inspection position. Because of the relative magnitudes of the signals, the outputs of comparator circuits 67 and 68 will be low, FIGS. 6*d* and 6*e*, indicating that the article being viewed is NOT Red and NOT Vegetable matter. On the other hand, the output of comparator 69 will go high, again indicating that an article is present at the viewing position. AND gate 72 has a low output which is inverted by inverter 74 to produce the high output of FIG. 6*g*. AND gate 77 will pass the long duration positive going waveform of FIG. 2*f* and the corresponding waveform of FIG. 2*h* is coupled as the data input to shift register 83. After experiencing a predetermined delay in shift register 83, the signal, FIG. 6*k*, is coupled to solenoid driver 90, FIG. 2. This signal is of sufficiently long duration to actuate solenoid operated valve 91 which in turn actuates paddle 95. Thus, the viewed dirt clod is deflected from the free fall path and is separated from acceptable red tomatoes.

If the article being viewed is an unacceptable green tomato, the output of comparator circuit 67, FIG. 3, will be low (NOT Red), and the outputs of comparators 68 and 69 will go high (Vegetable, and Article present). The output of AND gate 72 will be low because of the NOT Red input. The remainder of the circuit of FIG. 3 will operate the same as discussed above in connection with FIG. 4 to reject the green tomato.

It will be appreciated by those skilled in the art that the logic circuitry illustrated in FIG. 3 is but one example of suitable circuitry for achieving the desired operation. Other logic operations may be performed to achieve equivalent results.

I claim:

1. A method for sorting articles of produce according to a known characteristic manifested in radiation received therefrom and for sorting produce articles from nonvegetable articles, comprising passing desired articles of produce along with mingled undesired nonvegetable articles through an inspection position, detecting the presence of an article of the inspection position, receiving radiation from the article at the inspection position, in response to the received radiation determining if the detected article manifests said known characteristic by a predetermined amount, in response to the received radiation determining if the detected article is vegetable matter or nonvegetable matter, performing a first operation on a detected article if it manifests the known characteristic by the desired amount and is vegetable matter, and performing a different operation on a detected article if it does not manifest the known characteristic by the desired amount or is nonvegetable matter.

2. A method for sorting articles of produce according to a desired color characteristic of the produce and for sorting desired produce articles from mingled undesirable nonvegetable matter, wherein said articles of produce and nonvegetable matter are mingled together on a moving conveyor and moved past an inspection position, the steps comprising determining if an article is at the inspection position, determining if an article at the inspection position exhibits the desired color characteristic, determining if an article at the inspection position is vegetable matter, performing a given operation only if all of said determinations are affirmative.

3. A method for sorting articles of produce according to their color characteristics and for sorting produce articles to be retained from nonvegetable articles, comprising passing through an inspection position the articles of produce to be sorted along with nonvegetable articles mingled therewith, illuminating said inspection position with light in a band of wavelengths that includes visible and invisible light, detecting the presence of an article at the inspection position and producing a first electrical signal in response thereto, receiving light from an illuminated article at the inspection position and producing a second electrical signal corresponding only to a predetermined amount of received visible light at first wavelength associated with a desired color characteristic of the produce to be retained, receiving light from an illuminated article at the inspection position and producing a third electrical signal corresponding only to a predetermined amount of received invisible light at a wavelength that is absorbed by the produce to be retained but not by nonvegetable articles, directing the inspected article to a first path only in response to the presence of all three of said signals, directing the inspected article to a different path in response the absence of either one of said second and third signals.

4. A method for sorting articles of a given produce according to a desired color characteristic and for separating produce articles to be retained from undesired articles such as dirt clods and rocks, comprising passing through an inspection position the given articles of produce to be sorted along with undesired mingled dirt clods and rocks, illuminating the inspection position with light in a band of wavelengths that includes a narrow band of visible light centered at a wavelength corresponding to the wavelength of the desired color characteristic of the given produce, and two narrow bands of invisible light, one of the invisible bands being centered at a wavelength characterized by significant reflectance from vegetable matter that includes the given produce as well as from dirt clods and rocks, and the other invisible band being centered at a wavelength characterized by an absorption by said vegetable matter that includes the given produce but no absorption by dirt clods and rocks, receiving reflected light from articles of produce, dirt clods, and rocks passing through the inspection position, producing first, second, and third electrical signals corresponding, respectively, to the amount of light that exceeds predetermined magnitudes in said visible and two invisible bands, detecting the presence of said signals corresponding to received light in one of the invisible light bands to determine if an article is present at the inspection position, comparing said second and third signals to determine if an article present at the inspection position is vegetable matter rather than a dirt clod or a rock, comparing said first signal with one of the other of said signals to determine if a detected article at the inspection position has the desired color characteristic, taking no sorting action if the first one of the above determinations is negative, directing a detected article along a predetermined path if all of the above determinations are affirmative, and directing a detected article along a different path if either of the last two determinations are negative.

5. A method for sorting articles of a given produce according to a desired red color of that produce and for sorting undesired articles such as dirt clods and rocks from desired produce articles to be retained, comprising passing through an inspection position the given articles of produce to be sorted along with mingled dirt clods and rocks, illuminating said inspection position with light in a band of wavelengths that includes a narrow band of visible red light centered approximately at 660 nm and two narrow bands of infra red light respectively centered at approximately 800 nm and 990 nm, receiving light reflected from articles passing through said inspection position, producing a first signal in response to a given amount of received red light in said visible band, producing a second signal in response to a given amount of received invisible light in said 800 nm band, producing a third signal in response to a given amount of received invisible light in said 990 nm band, comparing one of said second or third signals with a reference signal to produce an article signal only when said second or third signal exceeds the reference signal by a given magnitude, thereby indicating that an article to be sorted is at said inspection position, comparing said first signal with one of said second or third signals to produce a color signal only when the magnitude of the first signal exceeds the magnitude of the second or third signal by a given magnitude, thereby indicating that an article having desired red color is being inspected, comparing said second and third signals to produce a vegetable signal only when said second signal exceeds said third signal by a given magnitude, thereby indicating that the article being inspected is vegetable matter and not a dirt clod or rock, directing the inspected article along a first path in response to the simultaneous occurrence of said color, said article, and said vegetable signals, and directing the inspected article along a different path upon occurrence of the article signal but in the absence of said color signal or said vegetable signal.

* * * * *